US005735734A

United States Patent [19]

Hertelendi

[11] Patent Number: 5,735,734

[45] Date of Patent: Apr. 7, 1998

[54] APPARATUS FOR GRINDING RAILS

[75] Inventor: Josef Hertelendi, Freilassing, Germany

[73] Assignee: Georg Robel GmbH & Co., Munich, United Kingdom

[21] Appl. No.: 646,974

[22] Filed: May 8, 1996

[30] Foreign Application Priority Data

May 19, 1995 [DE] Germany ..... 195 18 457.2

[51] Int. Cl.[6] ..... B24B 23/00

[52] U.S. Cl. ..... 451/347; 457/429

[58] Field of Search ..... 457/58, 65, 347, 457/236, 466, 429

[56] References Cited

U.S. PATENT DOCUMENTS

| | | | |
|---|---|---|---|
| 2,118,621 | 5/1938 | Perazzoli | 451/429 |
| 2,148,766 | 2/1939 | Mall | 451/347 |
| 2,324,263 | 7/1943 | Lowe | 451/347 |
| 3,154,892 | 11/1964 | Kruger | 451/347 |
| 3,205,623 | 9/1965 | Clayborne et al. | 451/347 |
| 4,862,647 | 9/1989 | Vieau | 451/347 |
| 5,575,709 | 11/1996 | Hertelendi et al. | 451/347 |

FOREIGN PATENT DOCUMENTS

| | | | |
|---|---|---|---|
| 1182281 | 11/1964 | United Kingdom | 451/347 |

*Primary Examiner*—Robert A. Rose
*Assistant Examiner*—George Nguyen
*Attorney, Agent, or Firm*—Henry M. Feiereisen

[57] ABSTRACT

Apparatus for grinding rails of a track, includes a carrier frame which has roller-type tracers adapted for mobility on the track and is swingably mounted to a support frame for rotation about a pivot axis oriented longitudinally in direction of the rail. The support frame is provided with rollers which can roll on the track, with each roller and each tracer having a roller tread. A guide member which is adapted for bearing upon a vertical side of the rail head is secured to the support frame and adjustable with respect to the carrier frame wherein at a horizontal disposition, the rotational axis of each tracer is in parallel relationship with the rotational axis of each roller, with the roller tread surface on contact with the rail defining a roller contact area which in the horizontal disposition of the tracer is disposed at a vertically elevated position in relation to a roller contact area defined by the tracer tread surface on contact with the rail.

16 Claims, 3 Drawing Sheets

APPARATUS FOR GRINDING RAILS

BACKGROUND OF THE INVENTION

The present invention refers to an apparatus for grinding rails of a track.

German Pat. No. DE 1 274 610 A describes a hand-held rail grinder which includes a carrier frame having roller-type tracers which roll on a rail head of a rail. The carrier frame supports a motor-driven grinding member which is manually adjustable via a spindle drive in its position relative to the rail. The carrier frame is swingably mounted on both its axial ends to a support frame which is supported by guide rollers for mobility along the track. The guide rollers are formed with rims and respectively supported in a forked roller mounting which is guided on the support frame for displacement relative thereto in direction of the rotational axes of the rollers. The carrier frame and support frame are adjustable in unison transversely to the track into various positions and secured in these positions by tension nuts to the guide rollers which remain in form-fitting engagement with the rail head. The connection between carrier frame and support frame is effected by two rockers which are secured to the carrier frame via a first pivot pin aligned longitudinally in direction of the rail, and to the support frame via a second pivot pin positioned in offset relationship to the first pivot pin.

German Pat. No. DE 2 908 244 A discloses a grinding apparatus including a frame extending longitudinally in direction of the rails and swingably mounted on both ends about an axis in parallel relationship to the rail for connection to respective support stands so as to be securely clamped on both sides of the grinding area to the rail being profiled. A locking mechanism effects a securement of the frame in each selected tilted position. The grinding member is provided on a carriage which is received in a longitudinal guide for displacement longitudinally in direction of the rails, with the longitudinal guide being mounted to the frame and having tracers which follow and duplicate the rail profile during displacement of the frame transversely to the rails. In order to compensate variations of the rail and to retain the tracers in close contact therewith, the longitudinal guide is slidingly supported upon the frame by columns that stand vertically to the longitudinal axis of the rails, and are loaded by return springs in direction of the rail.

International Pat. No. WO 91/08343 describes a rail grinder which is clampable to a rail and includes a grinding member in form of an abrasive disk that is adjustable perpendicularly to the rail and is guided for displacement in a frame-type longitudinal guide in parallel relationship to the rail. The frame is guided on both ends such as to follow a curved trajectory substantially parallel to the ideal surface of the rail. In addition, the frame is held by rollers along the rail for rolling across the rail head to thereby keep the grinding member at a constant distance from the actual rail profile.

German Pat. No. DE 43 16 252 A 1 describes a track-bound rail grinding apparatus with a grinding member that is secured on a swingable mounting which is rotatably connected to a lifting device for rotation about an axis longitudinally in direction of the rail. The lifting device is supported for vertical adjustment by a carriage which is secured to the carrier frame for horizontal displacement perpendicular to the longitudinal axis of the rail, with the carrier frame being mounted on an undercarriage for mobility along the rails. The adjustment of the grinding member with respect to a particular grinding point of the rail profile to be profiled requires three separate motions, namely transverse motion, vertical adjustment and tilting of the grinding member, which are executed by separate hydraulic drives and spindle drives. A similar arrangement is described in U.S. Pat. No. 4,993,193.

SUMMARY OF THE INVENTION

It is an object of the present invention to provide an improved rail grinding apparatus, obviating the afore stated drawbacks.

In particular, it is an object of the present invention to provide an improved rail grinding apparatus which enables an effective and accurate tracing of the rail head profile while affording the operator superior operating comfort in a safe working environment.

These objects, and others which will become apparent hereinafter, are attained in accordance with the present invention by a carrier frame provided with roller-type tracers and swingable by means of a swivel drive relative to a support frame, which has rollers forming a tread surface adapted for mobility on a rail, for rotation about a pivot axis extending longitudinally in direction of the track to allow adjustment of a grinding member with respect to the rail to be profiled, wherein at a horizontal disposition, the tracers rotate about a rotational axis in parallel relationship with a rotational axis of the rollers, with the tread surface of the rollers defining a lowermost area which in the horizontal disposition of the tracers is disposed at a vertically elevated position in relation to a roller contact area of the tread surface of the tracers on contact with the rail, and with the support frame being held in position during movement along the track by a guide which is secured to the support frame and adjustable with respect to the carrier frame and is adapted for impacting a vertical side of the rail head.

Through this particular disposition of the tracers and the rollers relative to each other, the horizontal rail tread as well as both vertical sides of the rail head can be profiled without any problems and at high accuracy, whereby the swivel drive assures a highest degree of comfort as far as ergonomics are concerned. During grinding of the rail tread and the upper rail head edges, the tilting of the tracers, which act as duplicating rollers, about the pivot axis is not adversely affected or impaired in any way as the rollers are prevented from contacting the rail, and the entire grinding apparatus is supported solely by the tracers on the rail. Thus, the rail profile on both sides of the grinding area can be precisely traced and copied at the grinding area by the grinding member in order to surface grind e.g. a welded rail joint. When tilting the carrier frame all the way to the side for grinding the rail head sides, the rail grinding apparatus is automatically lowered from the initially elevated position relative to the tracers until the rollers of the support frame bear upon the rail to assume the support function that was previously effected by the tracers. A lowering of the rail grinding apparatus in this manner not only improves a positioning of the grinding member relative to the rail side being ground but the grinding area can be expanded further downwards.

According to another feature of the present invention, the rollers of the support frame are formed as flanged rollers with lateral rims to assume a guide function to prevent the rail grinding apparatus from slipping off the rail when the carrier frame is swung about the pivot axis and the tracers and grinding member are laterally tilted. The operator is thus able to focus on balancing the rail grinding apparatus upon the rail and to concentrate on the operation of the swivel drive without neglecting safety measures, as all motions of the carrier frame and support frame relative to each other are automatically executed.

Each roller of the support frame is suitably received in a bearing structure in form of a transverse guide for support in a direction parallel to the rotational axis thereof to allow a displacement of the roller relative to the rail head. The bearing structure includes a carriage which is secured to the roller and is able to slide along a carriage guide that is received in a casing secured to the support frame. The carriage is loaded by a spring mechanism to seek a centered position within the casing and thus for the roller. Thus, when shifting the rail grinder from the rail tread sideways around the rail head flank to the vertical side, the decreasing pressure by the own weight of the grinding apparatus is compensated by the pressure applied by the spring mechanism for urging the grinding member into grinding contact with the side.

According to yet another feature of the present invention, the swivel drive is formed as bevel gearing, with a bevel gear secured to the carrier frame and a driving gear secured to the support frame, with the diameter of the bevel gear being a multiple of the diameter of the driving gear. The bevel gear is positioned coaxial to the pivot axis in a vertical plane extending perpendicular with respect to the longitudinal axis of the rail and is formed with a toothed rim that extends over at least 180° degrees of its circumference.

BRIEF DESCRIPTION OF THE DRAWING

The above and other objects, features and advantages of the present invention will now be described in more detail with reference to the accompanying drawing in which.

DETAILED DESCRIPTION OF PREFERRED EMBODIMENTS

Figure 1:
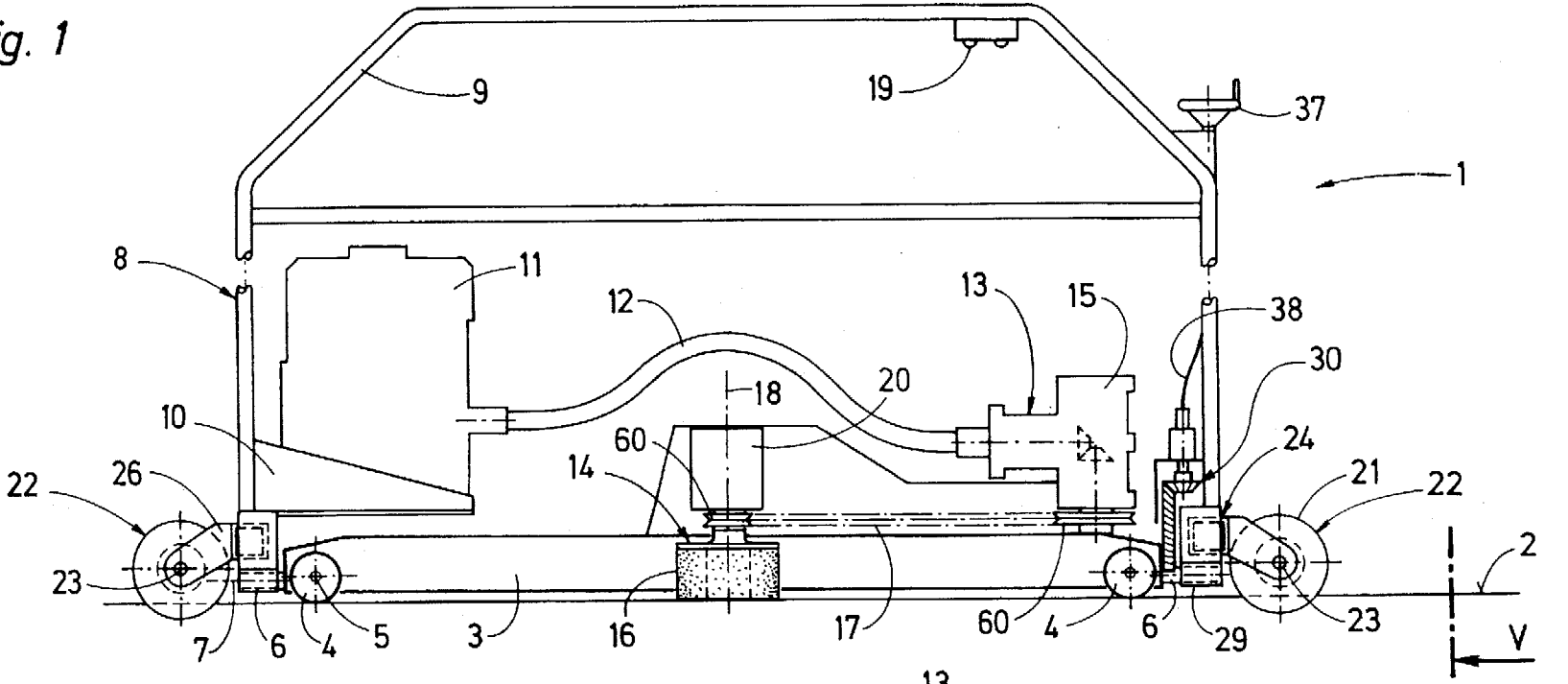
FIG. 1 is a side elevational view of one embodiment of a rail grinding apparatus according to the present invention.

Throughout all the Figures, the same or corresponding elements are generally indicated by the same reference numerals.

Figure 2:
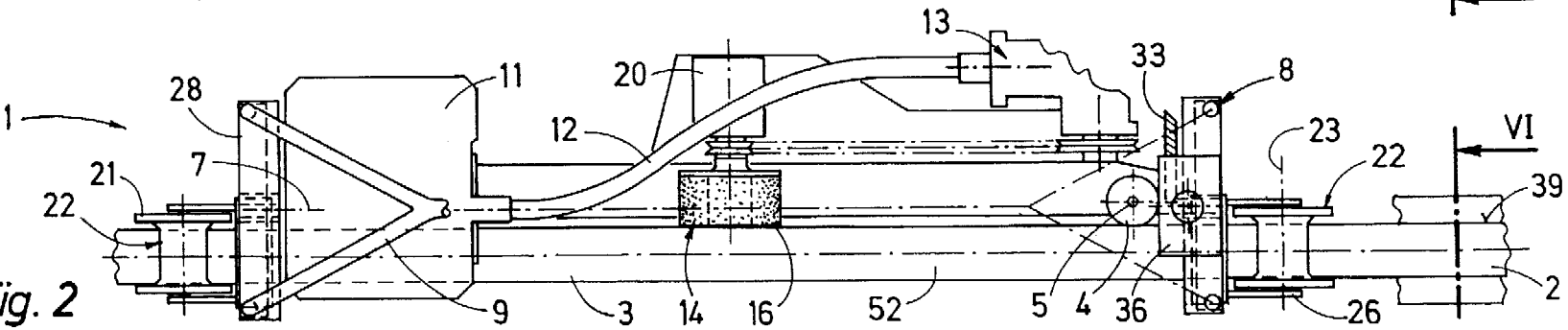
FIG. 2 is a top view of the rail grinding apparatus according to FIG. 1, showing in detail the grinding member in a laterally swung position for grinding a rail head flank.

Turning now to the drawing, and in particular to FIGS. 1 and 2, there are shown a side elevational and top view of a rail grinding apparatus, generally designated by reference numeral 1, for grinding surface irregularities on rails 2 of a track. The rail grinder 1 includes an elongated carrier frame 3 having opposite ends supported on the rail 2 to be profiled by two roller-type tracers 4 which are spaced from one another and each turning about a rotational axis 5. The carrier frame 3 is swingably mounted on both its ends to a support frame, generally designated by reference numeral 8 for rotation about an eccentric pivot axis 7 formed by a shaft 6 which extends longitudinally in direction of the rail 2. The support frame 8 is formed by an upwardly projecting U-shaped bar assembly 9 that bridges the carrier frame 3.

Secured to the support frame 8 is a mounting 10 for placement of a drive motor 11 which is connected via a flexible drive shaft 12 with a grinding unit, generally designated by reference numeral 13 and installed on the carrier frame 3. The grinding unit 13 includes a grinding member 14 which is disposed centrally between the tracers 4 and secured to the carrier frame 3, and an angular gearing 15 which receives the drive shaft 12. The grinding member 14 is formed as a cup wheel 16 that rotates about an axis 18 extending perpendicular to the longitudinal axis of the rail 2. A belt 17 trained over respective pulleys 48 connects the angular gearing 15 with the grinding member 14 for transmitting the power from the drive motor 11 to the grinding member 14.

The grinding member 14 is further acted upon by an adjusting drive 20 for displacement in direction of the rotational axis 18 perpendicular with respect to the rail 2 to be profiled. The adjustment is executed preferably electrically and is activated by a key 19 which is disposed in an upper area of the support frame 9.

Figure 4:
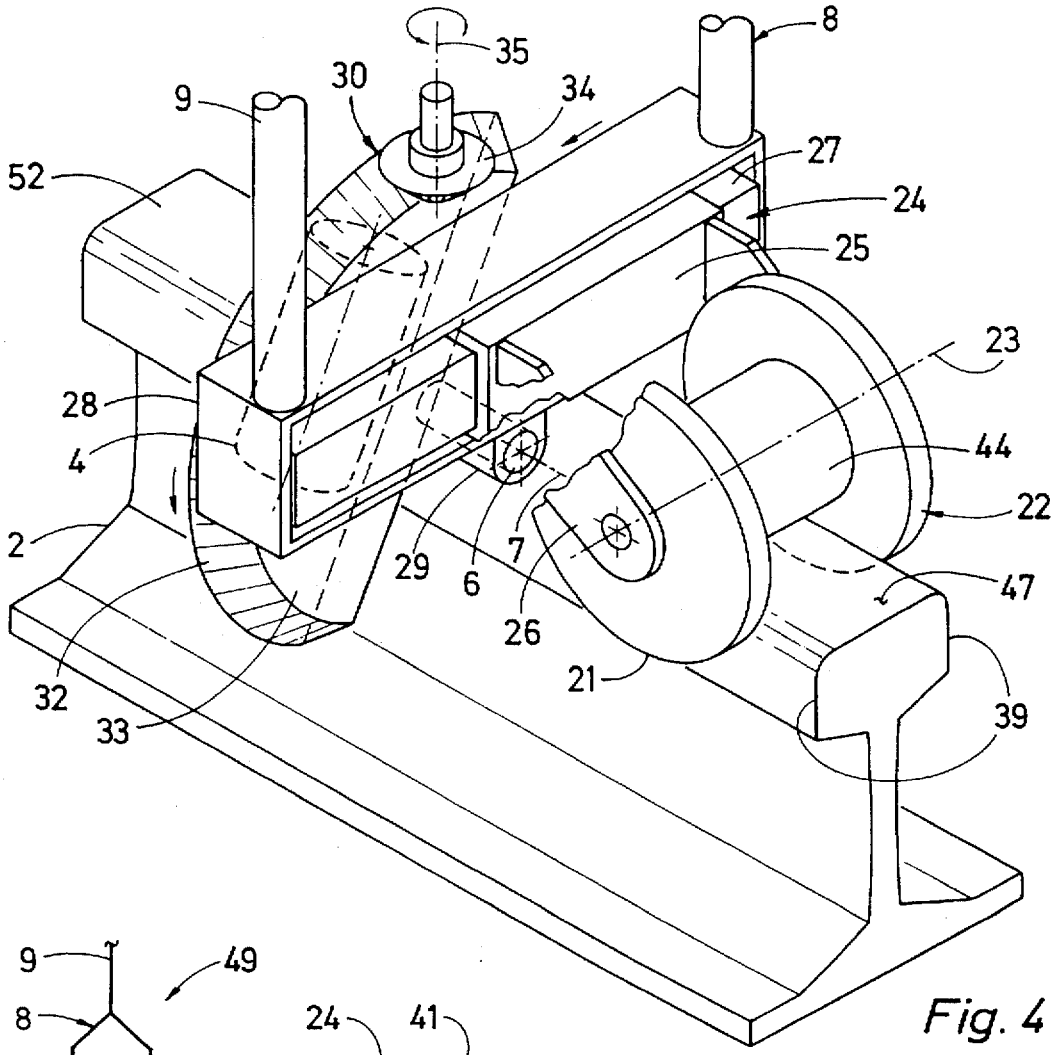
FIG. 4 is a simplified, enlarged perspective view of the swivel drive according to FIG. 3.

The support frame 8 has opposite ends which are each provided with a roller 22 which turns about a rotational axis 23 extending horizontal in parallel relationship to the rail tread 47. The roller 22 is formed as flanged roller with two rims 21 spaced from one another in direction of the rotational axis 23 to assume the function of a guide element during operation of the rail grinder 1 by impacting a vertical side 39 of the rail 2. The flanged rollers 22 are positionally adjustable in relation to the carrier frame 3 by a bearing structure in form of a transverse guide, generally designated by reference numeral 24 and shown in greater detail in FIG. 4.

The bearing structure 24 includes an elongated casing 28 of rectangular cross section which is open on the roller-facing side and extends across the rail 2. At its underside, the casing 28 is formed with a bearing block 29 for receiving the shaft 6 which is connected to the carrier frame 3. Received in the casing 28 is a carriage guide 27 of square cross-section for floatingly supporting a carriage 25 which thus can freely glide along the carriage guide 27. The carriage 25 is formed with journal bearings 26 for connection to the flanged roller 22. Positioned within the carriage guide 27 is a pressure-exerting element 41 in form of a spring 42 which is connected to the carriage 25 to load the latter in such a manner that the roller 22 seeks a centered position and in relation to the support frame 8, as shown in particular in FIG. 5. The roller 22 is thus adjustable relative to and supported by the support frame 8.

Figure 3:
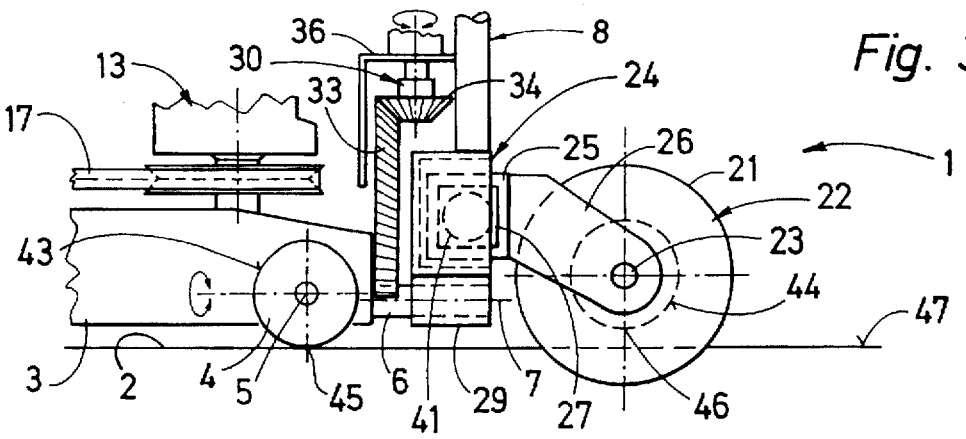
FIG. 3 is a fragmentary side view of the rail grinding apparatus, showing in particular the area of the swivel drive.

As shown in FIG. 3, the tracers 4 exhibit a tread surface 43, and the rollers 22 exhibit a tread surface 44 for rolling along the rail 2, with the tracer tread surface 49 defining a roller contact area 45 with the rail 2, and the roller tread surface 44 defining a lowermost area 46. As best seen from FIG. 5, in horizontal disposition of the tracers 4, their rotational axes 5 extend parallel to the rotational axes 23 of the rollers 22, with the lowermost area 46 of the rollers 22 being positioned at a vertically elevated position in relation to the roller contact area 45 of the tracers 4.

A tilting of the carrier frame 3 relative to the support frame 8 is effected by a swivel drive, generally designated by reference numeral 30 and, as shown in FIG. 3, positioned in the area of one connection zone between the support frame 8 and the carrier frame 3. The swivel drive 30 is formed as bevel gearing including a bevel gear 33 secured to the carrier frame 3 and a driving gear 34 connected to the support frame, with the diameter of the driving gear 34 being substantially smaller in comparison to the diameter of the bevel gear 33. The bevel gear 33 exhibits a toothed rim 32 which extends at least over 180° of the circumference of the bevel gear 33, as shown e.g. in FIG. 4. In the non-limiting example of the drawings, the bevel gear 33 of semi-circular configuration and is disposed in a vertical plane extending perpendicular to the longitudinal axis of the rail and coaxial to the pivot axis 7 defined by the shaft 6 while the driving gear 34 defines an axis 35 which is oriented at a right angle to the pivot axis 7 and is received in a mounting 36 of the support frame 8. A crank 37 (FIG. 1) is secured to the support frame 8 and connected to the driving gear 34 by a flexible shaft 38 to turn the driving gear 34 and to thereby effect and control the tilting of the carrier frame 3 sideways.

At operation, the hand-held grinding apparatus 1 is advanced manually along the rail 2 and moved back and forth at the grinding point, with the vertical disposition of the support frame 8 being retained throughout so that the support frame 8 in contrast to the carrier frame 3 does not undergo a tilting motion. Thus, the operator controls the rail grinder 1 in an ergonomically correct, comfortable upright position that allows activation of all controls to be carried out by hand through actuation of respective keys 19 disposed at the top of the support frame 8. Moreover, as there is no necessity to tilt the drive motor 11, a configuration as four-cycle engine with improved emission values and decreased noise level becomes possible.

Figure 5:
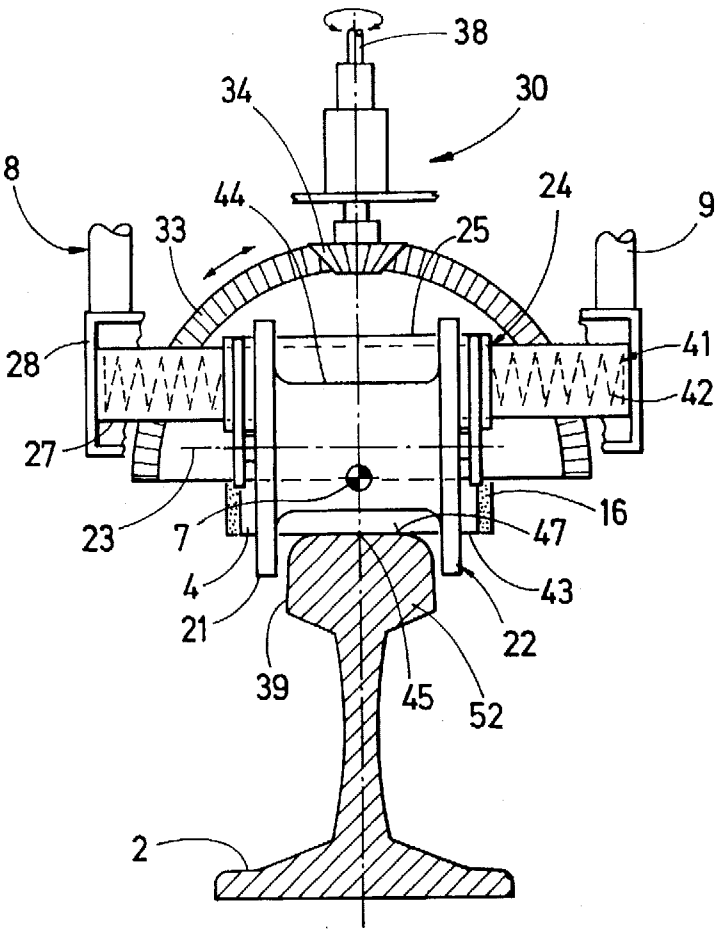
FIG. 5 is a front end view of the rail grinding apparatus in direction of arrow V in FIG. 1.

When grinding the horizontal rail tread 47 of the rail 2, the rail grinder 1 occupies the position shown in FIGS. 1 and 5, in which the carrier frame 3 is supported on the rail 2 by the tracers 4, with their rotational axes 5 extending horizontal. The support frame 8 also rests via the bearing structure 24 upon the tracers 4 as the rollers 22 are disposed at a vertically elevated position and thus are not in contact with the rail 2. The rims 21 of the rollers 22 are of such dimensions that despite the elevated position of the rollers 22 with regard to the rail 2, the rims 21 project downwards beyond the upper rail head edges to assume a guide function to prevent the rail grinder 1 from sliding off laterally from the rail 2. The operator controls the feed of the grinding member 14 by means of the adjusting drive 20 by correspondingly actuating the key 19, with the own weight of the rail grinder 1 generating the required pressure for pressing the cup wheel 16 into grinding contact with the rail 2.

Figure 6:
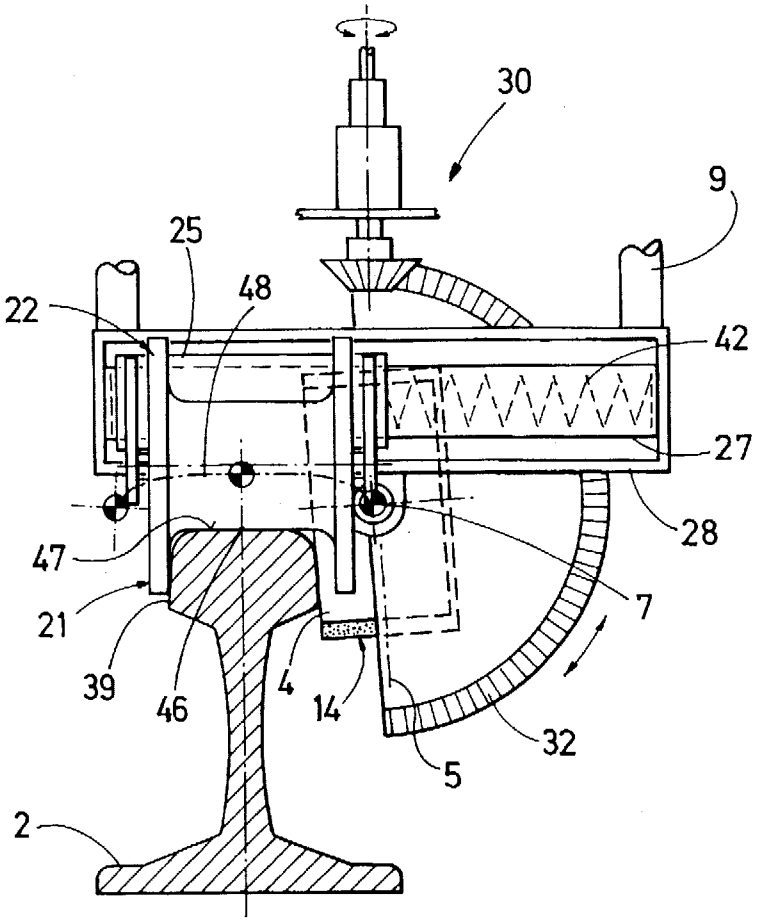
FIG. 6 is a front end view of the rail grinding apparatus according to arrow VI in FIG. 2.

When grinding a rail head edge or, as shown in FIGS. 2 and 6, one of the vertical sides (gage side or field side) 39 of a rail head 52, the operator needs only to turn the crank 37 in order to operate the swivel drive 30 and to thereby pivot the carrier frame 3. The shaft 6 is turned thereby about the pivot axis 7, and the tracers 4 are tilted to assume their function as duplicating rollers to follow the cross-sectional profile of the rail head 52. Thus, the carrier frame 3 and also the support frame 8 as a result of its linkage to the carrier frame 3 via the shaft 6 are automatically shifted sideways transversely to the longitudinal axis of the rail 2. The flanged rollers 22 are held by the rims 21 in their central position relative to the rail 2, with their rotational axes 23 extending in horizontal alignment. As a result, the carriage 25 is displaced in transverse direction relative to the carriage guide 27 of the bearing structure 24 and the pressure element 41 is compressed on the rail side that is opposite to the grinding point so that the grinding member 14 is pressed into grinding contact with the surface of the rail side 39 being profiled. This contact pressure increases proportionally to the tilting position of the carrier frame 3 and automatically substitutes thereby the necessarily decreasing contact pressure generated by the own weight of the rail grinder 1.

When machine the maximum tilting angle and the maximum transverse displacement of the carrier frame 3, the rotational axis of the tracers 4 occupies a substantially vertical position, as shown in FIG. 6 so that the rail grinder 1 is lowered in vertical direction by the distance defined between the lowermost area 46 of the tread surface 44 of the roller 22 in the initial position and the rail tread 47 of the rail 2. Dash-dot line 48 illustrates the arcuate path as covered by the pivot axis 7 between both possible extreme positions. Since both sides 39 of the rail head 52 can equally reached by the grinding member 14, there is no necessity to turn around the rail grinder 1 on the rail 2.

Figure 7:
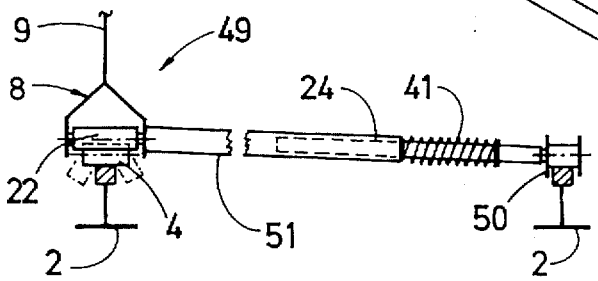
FIG. 7 is a simplified, schematic illustration of another embodiment of a rail grinding apparatus according to the present invention.

Turning now to FIG. 7, there is shown a simplified, schematic illustration of a rail grinder according to the present invention, generally designated by reference numeral 49. The difference of the rail grinder 49 compared to the previously described rail grinder 1 resides in the manner of guidance of the apparatus along the rail 2. In contrast to the previous embodiment in which the rollers 22 have spaced rims 21 and roll on the rail being profiled, the guidance of the rail grinder 49 is effected by spaced double-rimmed guide rollers 50 which roll on the rail that is opposite to the rail 2 to be profiled. Each double-rimmed guide roller 50 is also connected via a bearing structure in form of a transverse guide 24 to the support frame 8 and displaceable relative to the support frame 8 in transverse direction. The bearing structure 24 includes a telescopic beam 51 which is extendible or retractable and provided with a pressure-exerting element 41. The rollers 22 are secured to the support frame 8 such that a relative positional adjustment is prevented so that the rollers 22 of rail the grinder 49 are of simple structure without rims and of suitable dimensions, and thus cannot interfere with a required transverse displacement of the rail grinder 49 during tilting of the carrier frame 3 for grinding the lateral vertical sides of the rail head.

While the invention has been illustrated and described as embodied in a apparatus for grinding rails, it is not intended to be limited to the details shown since various modifications and structural changes may be made without departing in any way from the spirit of the present invention.

What is claimed as new and desired to be protected by Letters Patent is set forth in the appended claims:

I claim:

1. Apparatus for grinding rails of a track, comprising:

a support frame having rollers, each said roller rotating about a rotational axis and forming a tread surface adapted for mobility on a rail;

a carrier frame having roller-type tracers, each said tracer rotating about a rotational axis and forming a tread surface adapted for mobility on the rail;

a grinding member secured to the carrier frame;

a swivel drive for swinging the carrier frame in relation to the support frame about a pivot axis oriented in longitudinal direction of the rail to allow adjustment of the grinding member with respect to the rail to be profiled, wherein at a horizontal disposition, the rotational axis of each tracer extends in parallel relationship with the rotational axis of the rollers, with the tread surface of the roller defining a lowermost area that is disposed in the horizontal disposition of the tracers at a vertically elevated position in relation to a roller contact area defined by the tread surface of the tracer on contact with the rail; and guide means adapted for impact on a side of the rail for guiding the support frame during movement along the track, said guide means being secured to the; support frame and adjustable with respect to the carrier frame.

2. The apparatus of claim 1 wherein the guide means is formed by two rims secured to the roller at a distance from one another in direction of the rotational axis of the roller, and further comprising a bearing structure supporting the roller in a direction parallel to tho rotational axis thereof for allowing a displacement of the roller relative to the support frame.

3. The apparatus of claim 2 wherein the bearing structure is secured to the support frame for allowing the roller to freely slide in direction across the rail, said bearing structure including a pressure-exerting element for returning the support frame in a centered position relative to the rollers.

4. The apparatus of claim 2 wherein the bearing structure includes a carriage secured to journal bearings of the roller and a carriage guide secured to the support frame, said carriage being slidable along the carriage guide.

5. The apparatus of claim 4 wherein the carriage and the carriage guide are of square cross section.

6. The apparatus of claim 1 wherein the grinding member is formed as a rotating cup wheel defining an axes of rotation extending perpendicular to the longitudinal axis of the rail.

7. The apparatus of claim 1 wherein the swivel drive is formed as bevel gearing.

8. The apparatus of claim 7 wherein the bevel gearing includes a bevel gear secured to the carrier frame and a driving gear secured to the support frame, said bevel gear being positioned coaxial to the pivot axis in a vertical plane extending perpendicular with respect to the longitudinal axis of the rail.

9. The apparatus of claim 8 wherein the driving gear is defined by a diameter, said bevel gear being formed with a toothed rim extending at least over 180° of its circumference and exhibiting a diameter which is a multiple of the diameter of the driving gear.

10. The apparatus of claim 1, and further comprising a drive mechanism for operating the grinding member, said drive mechanism including a drive motor secured to the support frame, and a flexible driving shaft connecting the drive motor with the grinding member.

11. The apparatus of claim 1 and further comprising a remote-controlled drive mechanism secured to the carrier frame for adjusting the grinding member with respect to the rail in a direction vertical to the pivot axis.

12. The apparatus of claim 11 wherein the support frame is formed with an upwardly projecting bar assembly for accommodating operating elements for the drive mechanism and the swivel drive.

13. The apparatus of claim 1 wherein the guide means include a double-rimmed roller rolling on a rail opposite to the rail to be profiled, and further comprising a bearing structure for connecting the double-rimmed roller to the support frame such as to allow a transverse displacement of the double-rimmed roller relative to the supped frame.

14. The apparatus of claim 13 wherein the bearing structure includes a spring-biased telescopic beam extending actress the track between the double-rimmed roller and opposite roller on the rail to be profiled.

15. Apparatus for grinding surface irregularities of a rail of a track, comprising:

a support frame having first rollers adapted for mobility along the track;

a carrier frame having second rollers adapted for mobility along the track;

a grinding member secured to the carrier frame;

a swivel drive for pivoting the carrier frame with respect to the support frame between a horizontal position in which the first rollers are disposed at an elevated position in relation to the second rollers, with the grinding member positioned to profile the rail tread of a rail head, and with the second rollers rolling on the track, and a lateral position in which the first rollers are lowered onto the track while the second rollers move on the rail head to a lateral disposition to enable the grinding member to profile a side of the rail head; and guide means for guiding the support frame during movement along the track and adapted for bearing upon a side of the rail.

16. The apparatus of claim 15, and further comprising a pressure-exerting mechanism acting on the second rollers for loading the carrier frame in the lateral position to seek the horizontal position so that the grinding member is pressed into grinding contact with the side of the rail.

* * * * *

UNITED STATES PATENT AND TRADEMARK OFFICE

CERTIFICATE OF CORRECTION

PATENT NO. : 5,735,734
DATED : April 7, 1998
INVENTOR(S) : Josef Hertelendi

It is certified that error appears in the above-identified patent and that said Letters Patent is hereby corrected as shown below:

On the title page:

- [73] Assignee: change "United Kingdom" to --Germany--
- Claim 6, line 22, change "axes" to --axis--
- Claim 14, line 15, change "actress" to --across--

Signed and Sealed this

Thirtieth Day of June, 1998

*Attest:*

*Attesting Officer*

Bruce Lehman

BRUCE LEHMAN

*Commissioner of Patents and Trademarks*